US010058968B2

(12) United States Patent
Junker

(10) Patent No.: US 10,058,968 B2
(45) Date of Patent: Aug. 28, 2018

(54) GRINDING MACHINE AND METHOD FOR GRINDING WORKPIECES THAT HAVE AXIAL BORES AND PLANAR EXTERNAL SURFACES TO BE MACHINED ON BOTH SIDES

(71) Applicant: Erwin Junker Maschinenfabrik GmbH, Nordrach (DE)

(72) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 35 days.

(21) Appl. No.: 15/117,535

(22) PCT Filed: Feb. 13, 2015

(86) PCT No.: PCT/EP2015/053121
§ 371 (c)(1),
(2) Date: May 3, 2017

(87) PCT Pub. No.: WO2015/128210
PCT Pub. Date: Sep. 3, 2015

(65) Prior Publication Data

US 2017/0252886 A1 Sep. 7, 2017

(30) Foreign Application Priority Data

Feb. 25, 2014 (DE) ..... 10 2014 203 402

(51) Int. Cl.
*B24B 5/01* (2006.01)
*B24B 41/06* (2012.01)
(Continued)

(52) U.S. Cl.
CPC ..... *B24B 5/01* (2013.01); *B24B 5/04* (2013.01); *B24B 5/06* (2013.01); *B24B 27/0061* (2013.01); *B24B 41/067* (2013.01)

(58) Field of Classification Search
CPC ..... B24B 27/0061; B24B 41/067; B24B 5/01; B24B 5/04; B24B 5/06
See application file for complete search history.

(56) References Cited

U.S. PATENT DOCUMENTS 3,646,708 A * 3/1972 Jones ..... B24B 5/12 125/11.03
4,005,552 A * 2/1977 Hoglund ..... B24B 17/06 451/239
(Continued)

FOREIGN PATENT DOCUMENTS

DE 3628977 A1 3/1988
DE 3817161 A1 12/1988
(Continued)

OTHER PUBLICATIONS

International Search Report for PCT/EP2015/053121, dated Apr. 17, 2015.

*Primary Examiner* — Marc Carlson
(74) *Attorney, Agent, or Firm* — Marshall, Gerstein & Borun LLP

(57) ABSTRACT

A grinding machine for machining workpieces includes a workpiece headstock and two grinding headstocks. A first grinding headstock has two grinding spindles each with one grinding wheel for grinding first and second planar and non-planar external surfaces. A second grinding headstock has a grinding spindle having a grinding wheel for grinding a central bore in the workpiece, and a clamping device to clamp the workpiece. First, the bore and the first planar and any non-planar external surface are ground on one side of the workpiece. Then, the workpiece is clamped in the bore. The second planar external surface can then be ground in the same grinding machine with one of the grinding wheels of the first headstock. The clamping device attached to the second grinding headstock is such that the central axis of the
(Continued)

clamping device is exactly aligned with the central axis of the workpiece headstock.

22 Claims, 10 Drawing Sheets

(51) Int. Cl.
*B24B 27/00* (2006.01)
*B24B 5/04* (2006.01)
*B24B 5/06* (2006.01)

(56) References Cited

U.S. PATENT DOCUMENTS 4,051,830 A * 10/1977 Gruber ..... B24B 53/00 125/11.01
5,044,125 A * 9/1991 Lambert, Jr. ..... B23Q 15/12 125/10
5,076,022 A * 12/1991 Ohta ..... B24B 51/00 451/10
5,139,005 A * 8/1992 Dodd ..... B23F 23/1225 125/11.01
5,787,560 A * 8/1998 Schalles ..... B23B 3/30 29/27 C
6,685,536 B1 * 2/2004 Junker ..... B24B 5/16 451/221
7,032,484 B2 * 4/2006 Kobayashi ..... B23B 3/168 82/117
7,083,500 B2 * 8/2006 Junker ..... B24B 5/12 451/10
7,147,547 B2 * 12/2006 Junker ..... B24B 5/14 451/57
7,451,533 B2 * 11/2008 Kawasumi ..... B23B 3/167 29/27 C
8,182,313 B2 * 5/2012 Schaeferling ..... B23F 19/057 451/11
8,360,819 B2 * 1/2013 Junker ..... B24B 5/12 451/11
8,500,514 B2 * 8/2013 Osaka ..... B24B 47/22 451/10
8,579,676 B2 * 11/2013 Okada ..... B24B 5/04 451/11
8,851,957 B2 * 10/2014 Naya ..... B24B 1/00 451/11

FOREIGN PATENT DOCUMENTS

DE 19513963 A1 10/1996
DE 19753797 C2 2/2001
DE 102005018959 B3 8/2006
DE 60303672 T2 10/2006
DE 102012012331 A1 1/2013
EP 0573678 A1 * 12/1993 ..... B23B 3/30
EP 0573678 A1 12/1993
GB 2206826 A * 1/1989 ..... B23B 23/00
JP 2011131355 A * 7/2011
JP 2011131355 A 7/2011
JP 2012011535 A * 1/2012
JP 2012011535 A 1/2012

* cited by examiner

GRINDING MACHINE AND METHOD FOR GRINDING WORKPIECES THAT HAVE AXIAL BORES AND PLANAR EXTERNAL SURFACES TO BE MACHINED ON BOTH SIDES

CROSS-REFERENCE TO RELATED APPLICATIONS

The present application is the United States national phase International Patent Application No. PCT/EP2015/053121, filed Feb. 13, 2015, which application claims to German Application No. 10 2014 203 402.7, filed Feb. 25, 2014. The priority application is hereby incorporated by reference.

BACKGROUND

Grinding machines and a process for such a grinding, particularly of gearwheel parts for transmissions or flange parts, are already known, in which, in these known grinding machines and processes, several operations or partial operations are, indeed, carried out on a grinding machine; but a complete machining of such types of workpieces on one and the same grinding machine, on the other hand, is not known.

Lathes and grinding machines, by means of which an external cylindrical and an end surface machining of workpieces is carried out, are known from DE 10 2012 012 331 A1.

Two tool stocks positioned opposite to one another, which support several different tools and the external machining on the workpiece, have been described in connection with the known lathes. The workpiece is held by a first workpiece spindle, in which position the external machining and the end point of the workpiece positioned opposite to the clamping point can be machined. From the first workpiece spindle, it is possible to proceed to a workpiece, a second workpiece spindle positioned opposite to this, a so-called counter-spindle, so that the second, end surface of the workpiece that is first of all clamped can also be machined. If the clamping in the counter-spindle does not allow a machining in the area of the end surface, then the workpiece to be machined can be held centrally by means of a tip, which is attached to one of the tool holders or tool headstocks. In this case, however, the clamping remains held by the first tool headstock.

In the grinding machine described, a separate tailstock is positioned opposite the workpiece headstock. A grinding headstock with a grinding wheel can carry out the external cylindrical machining and also grind planar sides on flanges of the workpiece with its front surfaces, if necessary, but not at the immediate end, which is held by the tailstock. A second tool stock is positioned opposite to the grinding headstock and is configured as a multi-function unit. This multi-function unit supports a steady rest and measuring sensors, for example, in order to carry out in-process measurements. In addition, the multi-function unit supports a truing unit, so that the grinding wheel, which is located on the grinding headstock positioned opposite, can be trued. The tailstock and the grinding headstock are thus configured as separate units. The tailstock center attached serves only as a centering for the event that a so-called hub has first been brought into the workpiece. An internal grinding device is not described, either for the lathe or for the grinding machine.

A process and a grinding tool for the internal cylindrical and surface grinding of a workpiece in the form of a gearwheel are described in DE 10 2005 018 959 B3. An internal cylindrical grinding of the bore and a subsequent surface grinding of at least one planar surface on one side of the gearwheel are thus carried out with one and the same grinding wheel, which is profiled in such a way that two different conical areas are provided for the respective grinding tasks. A front conical area grinds the inner bore of the gearwheel, whereas a collar-like grinding area stepped behind the conical area is inserted for the one external planar surface on the gearwheel. The grinding spindle is thereby placed so obliquely, with reference to the cone angle, that the surfaces of the inner bore are ground coaxial to the central axis of the gearwheel. Corresponding to the cone angle of the second grinding area for the planar surfaces, such an angle of attack for the profiled grinding wheel is selected that the planar surface can be ground perpendicular to the central axis of the gearwheel. By means of such a profiled grinding wheel, the internal surface of the bore and the planar surface can only be ground in succession on the one external surface of the gearwheel. Clamping conditions and devices for the grinding of the planar side of the gearwheel positioned opposite are also not described.

A device for the grinding of workpieces with a workpiece holder and with at least one grinding tool is described in DE 197 53 797 C2. The workpiece can also be a gearwheel, in which the machining of its end surfaces is likewise carried out. The workpiece is clamped in a clamping device of the tool holder and the machining processes for the internal diameter, as well as the external contours, i.e., the planar sides, take place in succession there. After the finish grinding of the planar sides located on one side of the gearwheel, as well as of the internal diameter, the workpiece is unloaded from the machine by means of a hand-over device. A grinding of the opposing planar side is also not described in this known machine.

In addition, a grinding machine for the internal cylindrical, planar, and external cylindrical grinding is known from DE 36 28 977 A1. In this known grinding machine, a workpiece headstock is provided with a clamping chuck for the workpiece to be ground as a single clamping device.

The grinding of bores, external cylindrical and planar external surfaces is carried out by means of corresponding grinding wheels, which can be brought into grinding engagement on separate CNC-controlled grinding headstocks. A grinding of planar sides and opposing planar sides on one and the same workpiece is not described. The placement of two independent grinding headstocks has the positive result that both the external contours and an internal grinding of the bore can be processed simultaneously.

The known grinding machines and processes for the production of corresponding workpieces on these grinding machines have in common the fact that the workpiece to be ground in a machine cannot be machined completely.

Because a complete grinding process of the workpieces described above on one and the same grinding machine is not possible in the known grinding machines, additional machines, or at least corresponding additional grinding stations, must be made available for the complete machining of such types of workpieces. It is disadvantageous in this concept that a separate work sequence is therefore necessary, and the workpiece must be brought into another machine tool or an additional station for that purpose. Additional conveying devices are necessary for this. In addition, this results in the disadvantage that the workpieces must be exposed again to other ambient temperatures, and thus changed environmental influences, up to the loading in the second machine or second station, respectively, and thus also expand differently due to different thermal environmental conditions, if applicable, which can have a direct influence on the later precision of production.

In addition, a numerically controlled lathe is described in DE 195 13 963 A1, by means of which workpieces can be machined simultaneously on a workpiece spindle and on a counter-spindle, both internally and externally. The workpiece to be machined is clamped to the so-called workpiece spindle, as well as on the counter-spindle, and each can be provided with a drilling tool with an inner bore, whereby it can also be externally ground at the same time by means of tools, which are positioned on a tool support. Throughout the entire machining, the workpiece remains, in one and the same clamping operation, in the respective clamping chuck, and can thus not be machined in the clamping area.

A machine tool, by means of which cylindrical and planar external surfaces as well as bores can be machined on one tool, is described in DE 603 03 672 T2. For that purpose, a series of tool headstocks and a workpiece headstock are provided, so that the various tasks can be carried out on the workpiece. A complete machining is likewise not possible, because the workpiece remains clamped in the clamping chuck during the numerous machining processes to be carried out in the workpiece headstock.

A cylindrical grinding machine with numerical control for the grinding of chuck and pointed workpieces is described in DE 38 17 161 A1. By means of this known cylindrical grinding machine, internal grinding, external grinding, and planar grinding can be carried out between centers and with center and chuck. In the machining of so-called chuck workpieces, these remain clamped in the clamping chuck during the machining of the workpiece. When grinding so-called pointed workpieces, the external surfaces of the workpiece can, of course, be machined essentially completely, but a machining of bores is excluded in this clamping operation.

In the known grinding concepts, it is also disadvantageous that great difficulties result for the process planning, and a greater effort for the monitoring of the respective machining steps is necessary. This leads to greater costs because, for example, measuring instruments must be provided twice, if applicable.

In summary, it is to be noted that, in the known grinding machines or the processes carried out on the same, the present disadvantages lead to the fact that the workpieces are subject to certain restrictions in connection with highly precise production and are, on the other hand, more expensive to produce and must therefore be produced with higher production costs.

GENERAL DESCRIPTION

In contrast to this, the object of the present invention consists in providing a grinding machine and a process carried out by means of the same, by means of which workpieces with a central bore and both-side planar and/or non-planar external surfaces, particularly gearwheels for transmissions, can be ground completely and in a highly precise and economical way on a single grinding machine.

By means of the grinding machine in accordance with the invention, a complete machining of workpieces is carried out, which workpieces have at least a central bore as well as planar and non-planar external surfaces on both end surfaces of the workpiece, such as flanged shafts or gearwheels for transmissions, for example. The grinding machine in accordance with the invention has a first grinding headstock, on which an external grinding wheel for the machining of the corresponding external surfaces of the workpiece is positioned, a second grinding headstock, which supports an internal grinding wheel for the machining of the internal surface of the bore, and a workpiece headstock for the clamping of the workpiece. The workpiece to be ground is clamped in a clamping chuck of the workpiece headstock, so that the workpiece can be ground on the external surfaces and in the internal surfaces of the bore not covered by the clamping chuck. That is to say that, both the planar, and the non-planar, external surfaces, which point in the direction of the second grinding headstock, and the bore can be ground. The workpiece is now clamped in the workpiece headstock in such a way that it is set, in relation to its spatial arrangement, in a first clamping position on a central axis of the clamping chuck. In accordance with the invention, a clamping device is positioned towards or on the second grinding headstock, i.e., the second grinding headstock supports such a clamping device. The clamping device is connected fixedly with the second grinding headstock, which can be moved to the grinding headstock in a controlled manner, even if separately in relation to at least one CNC axis. For the grinding machine in accordance with the invention, the internal grinding wheel supported by the grinding headstock, the machining tool and, in accordance with the invention, the machining tool and the clamping device, are connected to a fixed unit, in the sense of a combo unit.

In principle, it may, first of all, appear to be disadvantageous to mount an additional clamping device on a grinding headstock, since the grinding headstock, as such, represents a highly complex and expensive component or an assembly that is expensive in terms of cost, which, if the clamping device is operative, is not usable for its actual task, that of grinding. This means that, if it is desired to achieve low cycle times, it is necessary to provide at least two grinding headstocks in order to be able to ensure that certain sections are ground at least temporarily simultaneously. Because of the high precision that is currently required when grinding and which must be achieved, the grinding headstocks are constructed in a correspondingly complex manner and with high stability. Surprisingly, it has now been shown that this high stability, which is advantageous for the clamping device as such, can be used without a second clamping device, which likewise has to have a high stability, needing to be provided. The clamping device profits, so to speak, from the internal stability and rigidity of the grinding headstock. As the result, there comes about, even in the combination of tool and clamping device, an assembly working in a highly precise manner, by means of which the production precision of complex workpieces can be additionally increased, and these workpieces can also be completely machined on a single machine, with relation to their central bore, as well as planar and non-planar external surfaces, on both sides.

The second grinding headstock supporting the clamping device is now movable in relation to the central axis of this clamping device in such a way that the clamping device is insertable into the bore of the workpiece already ground and the workpiece can thereby be clamped into a second clamping position. In this second clamping position, the central axis of the clamping device and the central axis of the clamping chuck align with one another, whereby both clamping positions exist simultaneously, at least temporarily. After the first clamping position is released and the second clamping position then represents the single clamping, a second planar and/or non-planar external surface is ground by means of the external grinding wheel, which surface points in the direction of the workpiece headstock.

By having realized the first and the second clamping position such that their central axes align with one another and, after release of the first clamping position, the spatial positioning of the workpiece to be ground is maintained with high precision, a high grinding precision can be achieved and, specifically so, for the first planar side and the opposing planar side, which is to be understood as the second planar external surface, which is directed at the workpiece headstock.

Preferably, the clamping device is a clamping mandrel that is movably controlled by CNC in the axial direction and is, in particular, driven in a rotary manner. However, technical implementations, in which the mandrel does not need to be displaced along its longitudinal axis and has only a rotational drive, are also conceivable. The axial mobility that then occurs, either on the mandrel or through the second grinding headstock over the Z2 axis, serves for the purpose of moving the mandrel, for optimal clamping conditions, into the central bore of the workpiece far enough that this is clamped reliably and without causing oblique clampings, so that the central axis produced in the workpiece spindle by means of the clamping device is preserved there after handing over of the workpiece to the mandrel.

The mandrel is preferably configured as a hydro-expansion element. One such type of hydro-expansion element has an area that can be acted upon with a hydraulic fluid which, under the effect of a greater pressure of the hydraulic fluid, is deformable in such a way that the external surfaces of the mandrel are applied against the internal surfaces of the bore with such force that the workpiece is firmly clamped in the bore. The advantage of a hydrostatically working mandrel consists, among other points, of the fact that the clamping is produced in a short time and can be released again in just short a time. In addition, hydro-expansion clamping elements have very good values in regard to the precision of the clamping. Furthermore, the size of the clamping force can be controlled by the level of the pressure of the hydraulic fluid.

Preferably, the first grinding headstock has two grinding spindle units with corresponding grinding wheels, by means of which at least the first and the second planar external surfaces on the workpiece are grindable. The grinding spindle units can be moved in the X1 and Z1 axial direction controlled by CNC, so that every position in the X1-Z1 plane can be approached with a high precision corresponding to the grinding conditions. In addition, the grinding headstock has a B-axis, which is likewise CNC-controlled and with which the respective grinding wheels on the corresponding grinding spindles can be swiveled into grinding engagement position on the workpiece. One advantage of this arrangement of two grinding spindles on the first grinding headstock consists of the fact that a high flexibility with regard to the external surfaces to be ground can be achieved, with an optimization of the grinding effort and simultaneous increase of the production precision, through a modification in the corresponding grinding wheels.

In accordance with one additional embodiment, the first grinding headstock is provided with a truing spindle which preferably has a diamond truing disk for the truing of the internal grinding wheel. The advantage consequently consists of the fact that the two grinding headstocks provided for the grinding machine in accordance with the invention cooperate to the extent that the one grinding headstock (the first) can be trued with the truing spindle of the grinding wheel of the other grinding headstock (the second) positioned there, in order, after corresponding grinding wheel abrasion, to again be able to achieve the desired grinding conditions for a high grinding precision.

Preferably, the second grinding headstock with the grinding spindle unit positioned on it can, for the grinding of the internal surfaces of the bore, be moved in a CNC-controlled manner in the X2 and Z2 axial direction. Thus, the second grinding spindle unit can also be moved, together with the clamping device or the mandrel, within the X2-Z2 plane in such a way that every necessary point on the workpiece can be moved to.

More preferably, the workpiece headstock has two workpiece spindles, each with a clamping chuck, which are positioned 180 degrees opposite one another. The respective workpiece spindle can be swiveled, by means of a rotating unit on the workpiece headstock, from a first position in which at least the first planar external surface and, if necessary, also the non-planar external surfaces, as well as the internal surface of the bore of the workpiece to be ground, can be ground, to a second position, in which the next workpiece is loaded. A new workpiece still to be ground can be loaded into the workpiece headstock, which is subsequently swiveled into the grinding position by 180 degrees.

More preferably, the two grinding headstocks are each positioned on a cross-slide, so that a reliable, CNC-controlled movement within an X1-Z1 plane and an X2-Z2 plane can take place.

Since two grinding headstocks in the grinding machine in accordance with the invention are present, and the first grinding spindle unit supports the external grinding wheel and the second grinding spindle unit supports the internal grinding wheel, these two grinding wheels are, more preferably, brought into grinding engagement in a controlled manner, so that at least the first planar external surface and the bore are grindable at least temporarily simultaneously. The cycle time for the production of the workpiece can thus be reduced, whereby, through the simultaneous grinding of the internal surfaces of the bore and of the planar and non-planar external surfaces by means, in particular, of a profiled grinding wheel by the respective grinding wheels, the grinding forces that are applied can be compensated, at least in certain ways, with the result that the precision of the grinding result can be increased.

In accordance with a second aspect of the invention, the process for the complete grinding of workpieces, particularly gearwheels for transmissions, is carried out with a central bore and planar as well as non-planar external surfaces on a previously described grinding machine. In the process in accordance with the invention, a workpiece is, first of all, clamped into a workpiece headstock. In this clamping position, first of all, the first external surfaces on the clamped workpiece are ground and internal surfaces in the central bore of the workpiece are at least temporarily simultaneously completely finish-ground by means of an internal grinding wheel. A clamping device which forms a fixed unit with the grinding headstock supporting the internal grinding wheel, is subsequently inserted into the bore of the workpiece and the workpiece is at least temporarily simultanously clamped with regard to the clamping into the tool headstock. The firm clamping by the clamping device is thus carried out in such a way that the central axes of the clamping chuck of the workpiece headstock and the clamping device on the second grinding headstock align with one another. As a result, the position of the workpiece in the space from the first clamping position to the tool headstock is maintained and that is the case even if the clamping of the tool headstock is later relieved. After the release of the clamping by the workpiece headstock, the second external surfaces, which are positioned opposite the first external surfaces on the workpiece and which, because of the clamping in the tool headstock, cannot initially be ground, are then completely finished. The combination of a clamping device with a grinding headstock here offers a highly precise clamping, i.e., the passing over of a workpiece clamped with the workpiece headstock to a second clamping in the central bore of the workpiece by means of the clamping device. A complete grinding operation can thus be carried out on such types of workpieces on one and the same grinding machine with the process in accordance with the invention.

The clamping device is preferably controlled hydraulically from its release position into its clamping position and vice versa. The hydraulic control of the clamping device for the purpose of the clamping, as well as for the purpose of the release from a clamping position, has the advantage that it is carried out only through the pressure of the hydraulic fluid and, as the result, both a clamping and a release can be carried out in short times.

More preferably, the clamping device can also be guided mechanically, electrically, or electromagnetically from its release position into its clamping position and vice versa. The type and manner of the physical principle of the control of the clamping device thereby depends on the respective case of application, whereby the advantages of the respective physical control principles are known to the here relevant average person skilled in the art.

Preferably, the workpiece headstock is swiveled from a position in which a clamping device holds the workpiece in a grinding position into a loading position, after the workpiece has been completely finished and, specifically, in relation to the first and the second external surfaces, as well as to the bore, from which—because the workpiece headstock preferably has two clamping devices—a new workpiece to be ground is swiveled back into a grinding position. As a result, cycle time is saved because, when swiveling a workpiece to be ground into the grinding position, i.e., into the first clamping position, no additional auxiliary process times for the clamping of the next workpiece arise.

In accordance with one additional preferred configuration of the invention, the second planar external surfaces are ground in the straight plunge grinding process. This is, above all, advantageous if the opposite planar surface has no shoulders or recesses that have non-planar surfaces and would, preferably, have to be ground with a profiled grinding wheel. The grinding by means of a straight plunge grinding process is preferably carried out there in such a way that different grinding wheels for the external surfaces are used on the one side of the workpiece and, for the external surfaces, on the other side of the workpiece. The first planar and non-planar external surfaces are preferably ground by means of a profiled grinding wheel. The profiled grinding wheel facilitates a simultaneous grinding of the first external surfaces to be ground, whereby cycle time likewise can be saved in the production of the workpiece.

In accordance with one additional preferred configuration of the invention, cooling lubricant is fed through the interior of the workpiece headstock to the internal grinding wheel. In that way it is possible to carry out the grinding process on the internal surfaces of the bore optimally, without cooling lubricant supply lines in the area of the grinding spindle or the internal grinding wheel, which would be disruptive.

The process is preferably configured in such a way that the internal grinding wheel first of all rough grinds and then finish-grinds the bore. In addition, the internal grinding wheel has two grinding areas that are brought into engagement in the internal surface of the bore in succession. As a result, a reclamping or the coordination, respectively, of a rough-grinding wheel otherwise to be used, and the subsequent use of a finish-grinding wheel, is not required.

BRIEF DESCRIPTION OF THE DRAWINGS

Additional advantages, characteristics, and possibilities of use of the present invention will now be illustrated in further detail by means of the diagrams. The diagrams depict the following.

DETAILED DESCRIPTION

Figure 1:
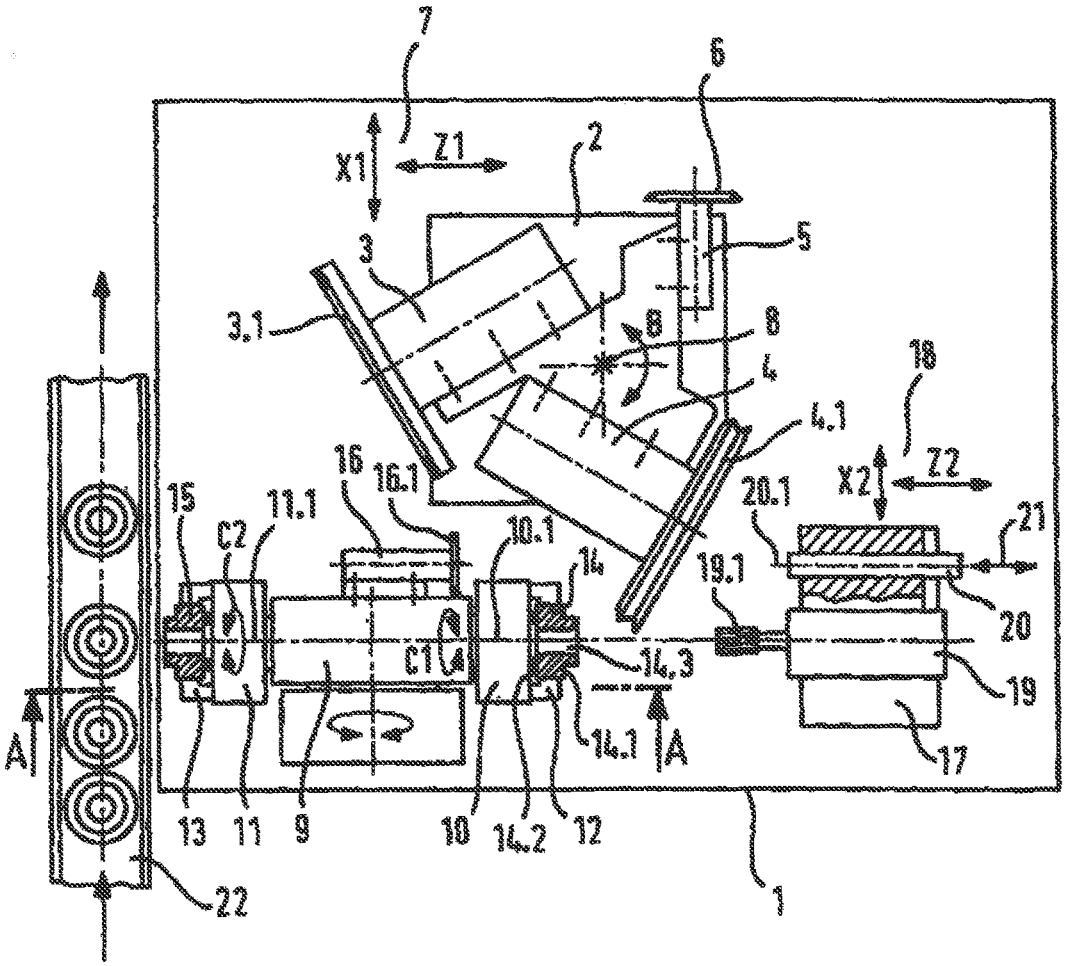
FIG. 1: A top view of the grinding machine in accordance with the invention in basic representation.

FIG. 1 depicts, in basic representation, a top view of the grinding machine in accordance with the invention, which also carries out the process in accordance with the invention. A first grinding headstock 2, a second grinding headstock 17, and a workpiece headstock 9, which are present in a defined relation to one another, are positioned on a machine base 1. The first grinding headstock 2 supports a first grinding spindle 3, on which a grinding wheel 3.1 is positioned. An additional grinding spindle 4, which accommodates an additional grinding wheel 4.1, is attached to the first grinding headstock 2. The grinding wheel 4.1 is profiled and serves for the grinding of the first planar external surfaces 14.1, as well as the non-planar external surfaces 14.4 of a workpiece 14, which is clamped in a clamping device 12 of a first workpiece spindle 10 which, being controlled by CNC, sets the axis C1 of the workpiece 14 in rotation. The profiled grinding wheel 4.1 is brought into grinding engagement on the workpiece 14 controlled by CNC by means of the axes X1 and Z1 of the first grinding spindle unit 2.

The first grinding headstock 2 has, in addition, a B-axis proceeding perpendicularly in the drawing plane, so that, by means of a swiveling movement around the B-axis of the grinding headstock 2, the profiled grinding wheel 4.1 or the grinding wheel 3.1 can optionally be brought into engagement with the workpiece. The grinding wheel 3.1 is provided for the grinding of the second planar external surface 14.2 on the workpiece. In the representation depicted in FIG. 1, the second planar external surface 14.2 is clamped within the clamping device 12 of the workpiece spindle 10, and thus cannot be ground while this is clamped.

The profiled grinding wheel 4.1 is configured in such a way and can be brought into grinding engagement on the external contour to be ground, that the internal grinding wheel 19.1, which is positioned on the second grinding headstock 17 with the grinding spindle 19, can simultaneously be brought into the bore 14.3 of the workpiece 14, at least temporarily, so that the bore 14.3 of the workpiece can be completely finish-ground, without cycle time being lost as a result. In contrast to that, the grinding operations are carried out in succession on the external surfaces and on the internal surface in grinding machines or processes in accordance with the state of the art.

The second grinding headstock 17 is configured as a combination unit, while an additional clamping device 20 is mounted on the grinding headstock, which clamping device, can, on the one hand, be moved by means of the CNC axes X2 and Z2 with the grinding headstock 17 within the X2-Z2 plane, and whereby, in addition, the clamping device 20 can undergo an axial displacement 21 along a central axis 20.1.

After the planar 14.1 and the non-planar external surfaces 14.2, as well as the internal surface of the bore 14.3, are completely finish-ground, the grinding headstock 17 aligns, in relation to its central axis into the X2 direction process, to the extent that the central axis 20.1 of the clamping device 20 aligns with the central axis 10.1 of the workpiece spindle 10 of the workpiece headstock 9. In this position of the headstock 17, the clamping device 20 is inserted into the bore 14.3 and accommodates the workpiece in the form of a clamping. The workpiece is thereby clamped over a defined, relatively short time, both in the clamping device 12 of the workpiece headstock 9, and by means of the clamping by the clamping device 20. After the clamping of the workpiece 14 has been carried out by means of the clamping device 20, the clamping device 12 is detached from the workpiece headstock 9 and the second grinding headstock 17 is moved. As a result, the second planar external surface 14.4 is released, so that, by means of the first grinding headstock 2, the grinding wheel 3.1 can enter into the grinding position. The grinding wheel 3.1 is configured as a planar grinding wheel, so that the second planar external surface 14.2 is produced by way of straight plunge grinding. It is thus possible to finish-grind a workpiece, particularly in the form of a gearwheel for transmissions, in one and the same grinding machine in relation to the front, as well as the rear external side surfaces and the internal surfaces of the bore. Thereby, it can be ensured that the individual ground portions on the workpiece are finish-ground with slight dimensional, positional, and form tolerances to one another.

The workpiece headstock 9 is configured in such a way that two spindles, which are positioned opposite one another in a 180° placement, are present on the workpiece headstock 9. In the diagram, on the right side, the workpiece headstock 10 is provided with its central axis 10.1 and the clamping device 12 attached to it. On the left side of FIG. 1, the second workpiece spindle 11 is provided with its central axis 11.1 and the clamping device 13. While the workpiece spindle, with its clamping device 12, has clamped a just ground or even a completely finish-ground workpiece 14, a workpiece 15 still not ground is already clamped with the second workpiece spindle 11, i.e., with its clamping device 13. The workpiece 15 can be driven by the second workpiece spindle 11 by means of a CNC-controlled axis C2. The workpiece headstock 9 is now swivelably positioned in such a way that, first of all, the workpiece 15 newly accommodated in the loading position can be brought into a grinding position. This takes place in a very short time because of the double arrangement of the workpiece spindle on the workpiece headstock 9. It is achieved thereby that the auxiliary process times in the grinding machine are minimized.

A truing spindle 16 with a truing disk 16.1, by means of which the grinding wheels 3.1 and 4.1 of the first grinding headstock can be trued, is additionally attached to the workpiece headstock 9. The first grinding headstock 2 has an additional truing spindle 5 with a diamond truing disk 6, by means of which the internal grinding wheel 19.1, which is also termed a grinding mandrel, can be trued.

Next to the machine base 1 of the grinding machine, the feeding of the raw parts to the grinding machine and the removal of the finished parts from the mandrel 20 and from the grinding machine take place fully automatically with a handling system, not depicted, through the feed belt/discharge belt 22 which is positioned, in FIG. 1, left side, next to the machine base 1 of the grinding machine. In order to feed the workpieces to the grinding machine or to unload them from the machine after they have been finish-ground, special handling devices are provided, which are not described separately here, since they are not of separate significance for the present invention. Through the arrangement of two workpiece spindles 10, 11 on the workpiece headstock 9, it is possible to carry out the loading with new raw workpieces 15 provided for the grinding in the auxiliary process time. The swiveling of the raw workpieces from the loading position requires, with the present workpiece headstock 9, for example, less than 2 seconds. The loading into the clamping chuck 13 can, in regard to the time necessary for it, be carried out in all cases, to the extent that this is not critical, in a shorter time than the grinding time requires for the complete grinding of the workpiece 14. In any event, the loading into a clamping chuck with the clamping and the corresponding handling movements usually take place within a time of approx. 8 seconds. Since this takes place in the auxiliary process time, i.e., in a time in which the workpiece 14 is machined, the entire cycle time for a workpiece can be further reduced, which has a favorable effect on the production costs of the workpieces.

Figure 2:
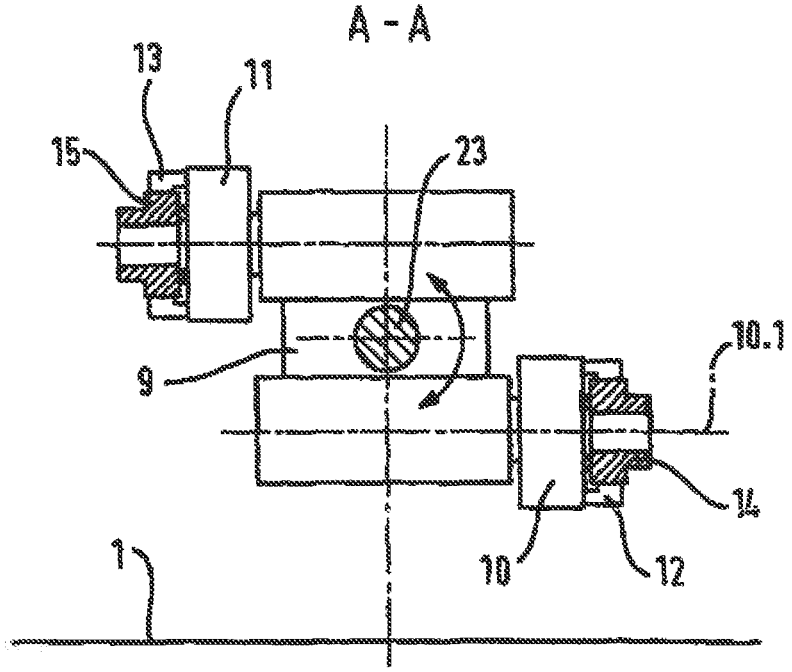
FIG. 2: A partial sectional view of the cutting plane A-A for the workpiece headstock from FIG. 1.

FIG. 2 depicts, in a partial section along the plane A-A in accordance with FIG. 1, how the arrangement of the two workpiece spindles 10, 11 on the workpiece headstock 9 is designed. Both workpiece spindles 10, 11 can be swiveled, by means of a rotating unit 23, from a grinding position which, in FIG. 2, corresponds to the placement of the workpiece 14, into a loading position which, in FIG. 2, corresponds the workpiece 15. Thus, the two workpiece spindles 10, 11 can alternately be moved into the machining position. The machine base 1 is marked schematically in this partial sectional view A-A of the workpiece headstock. As a result of the fact that the workpiece spindle 10, i.e., in FIG. 2, the lower workpiece spindle for the grinding of the external and internal contours of the workpieces 14, is positioned closer to the machine base during the grinding engagement, the thermal change of the grinding machine is eliminated to the greatest extent possible and the rigidity of the entire assembly is, because of the improved leverage effect, likewise greater.

As a result, a greater precision can be achieved during the grinding process, in relation to the attainable maximum dimensional and shape precisions on the finish-ground workpiece. As already mentioned in connection with the description of FIG. 1, during the grinding operation on the workpiece 14, a loading onto the workpiece spindle 11 or of the clamping device 13 is carried out with a new raw workpiece 15. That means that the loading takes place during the grinding process. The loading movements are programmed in such a way that the loading cycle, for example, does not coincide with the point in time of obtaining the final dimension on the workpiece 14. Through this special programming, an additional optimization of the attainable quality of the workpiece 14 in the grinding machine is possible. The loading and unloading of the workpiece is, therefore, carried out in so-called auxiliary process time. In order to carry out the actual grinding process on the workpiece 14, only a swiveling process of the workpiece 15 into the position of the workpiece 14 in accordance with FIG. 2, which takes only a small amount of time, needs to be carried out. The workpiece 15 becomes, so to speak, a workpiece 14, if the grinding operation is taken up on the workpiece or if this has completely ended. As a result, the actual time for the unloading or the cycle time does not count, but only the swiveling time out of the loading position into the grinding position.

Figure 3:
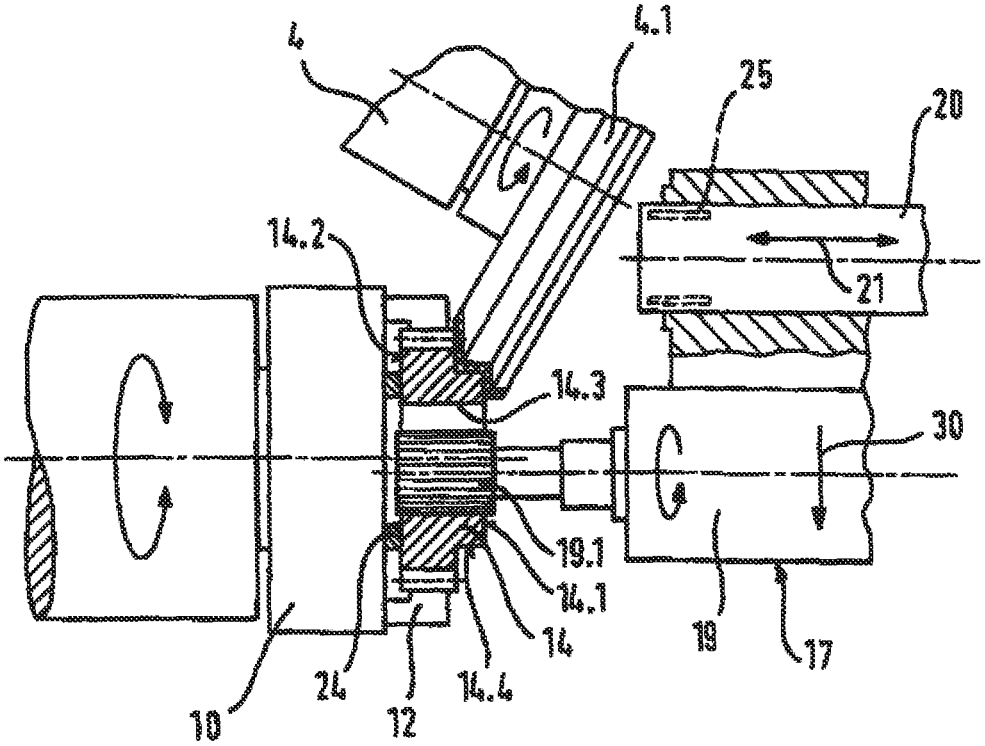
FIG. 3: In basic representation, the simultaneous engagement of a profiled grinding wheel of the first grinding headstock and of the internal grinding wheel of the second grinding headstock.

An enlarged partial view of the area of the grinding machine in accordance with FIG. 1 is depicted in FIG. 3, which depicts the workpiece headstock 10 with the workpiece 14 clamped, in which the grinding wheel 4.1 is in engagement therewith and the internal grinding wheel 19.1 for the grinding of the internal surface of the bore 14.3 is likewise engaged with the second grinding headstock 19. During the machining, the workpiece 14 is—as depicted in this FIGURE—firmly clamped in the clamping chuck 12. For the precise alignment and for the determination of the longitudinal position in the clamping chuck, the workpiece 14 is in contact with a stop ring 24 in the clamping chuck. Now, with such a plane of reference, the workpiece 14, which is firmly clamped in the clamping chuck 12 by means of the workpiece spindle 10 and rotationally driven controlled by CNC in relation to its external contour, in the form of the first planar external surfaces 14.1 and non-planar external surfaces 14.4, is ground by means of the profiled external grinding wheel 4.1 on the grinding spindle 4. The bore 14.3 of the workpiece 14 is ground, simultaneously with the internal grinding wheel 19.1, which is driven in a rotary manner by the grinding spindle 19 attached to the second grinding headstock 17. These two machining steps can be carried out at least partially or completely simultaneously. The latter is obviously only applicable if the machining times for both machining processes are approximately equally long. The time-parallel machining of the external surfaces 14.1 and 14.4, as well as of the bore 14.3, leads to reduced machining times or cycle times, and thus to reduced workpiece expenses. Since both the drives for the external grinding wheel 4.1, and those for the internal grinding wheel 19.1, are controlled by CNC, both machining processes can, if this should be advantageous for a specific workpiece, also be carried out partially or completely, in staggered succession. This could, indeed, increase the cycle time, but, for considerations of grinding technology, can definitely be advantageous for specific workpieces.

In FIG. 3, the feeding direction of the internal grinding wheel 19.1 or of the grinding pin, during the grinding, is indicated in the direction of arrow 30. In principle, however, it may also be advantageous to carry out the feeding direction in the reverse direction. This depends greatly on the structural configuration of the grinding machine. By this measure, rigidity values and temperature drifts out of the grinding machine can be positively exploited, so that the grinding results are further optimized in regard to precision.

A clamping device 20 is also attached, preferably in the form of a mandrel, which is depicted in the area of the headstock 17 depicted in the partial section, to the same casing as that on which the grinding spindle 19 is attached to the second grinding headstock 17. The mandrel is driven in an automatic, axially displaceable (21) and rotary manner. Because of the possibility that the second grinding headstock 17 is also configured along its X2 and Z2 axis in a movable manner, the mandrel 20 can align its central axis 20.1 with an aligning orientation to the central axis 10.1 of the workpiece spindle 10 and, in this position, carry out, in relation to the support position of the workpiece in the space, a clamping that is identical to the clamping by the workpiece spindle 10 with the clamping chuck 12. In this way, a high precision of the machining of the workpiece is possible since, for each of the two clampings, the same position of the workpiece in relation to the central axis is reduced in the clamped condition.

The grinding with both the internal grinding wheel 19.1 and the external grinding wheel 4.1, mostly takes place with CBN coating, whereby ceramically bound CBN coating is preferably used. Other abrasives, such as corundum or other bonds of the CBN coatings, for example, are obviously also possible, whereby the respective optimal grinding coatings are each selected in accordance with the machining task.

In the mandrel 20 depicted in FIG. 3 and, specifically, on its left-hand side, a clamping element 25, which is automatically opened or closed, i.e., is clamped by the grinding program, is shown in the end area and is provided for the actual clamping of the workpiece 14 in the bore 14.3. In this case, a hydro-expansion clamping element is depicted. Such a hydro-expansion clamping element is expanded through being acted upon with a hydraulic fluid for the activation of the clamping. For release, the pressure of the hydraulic fluid is reduced correspondingly. Other clamping elements, such as collet chucks or even an internal clamping chuck, i.e., a mechanical chuck, are obviously also possible.

Figure 4:
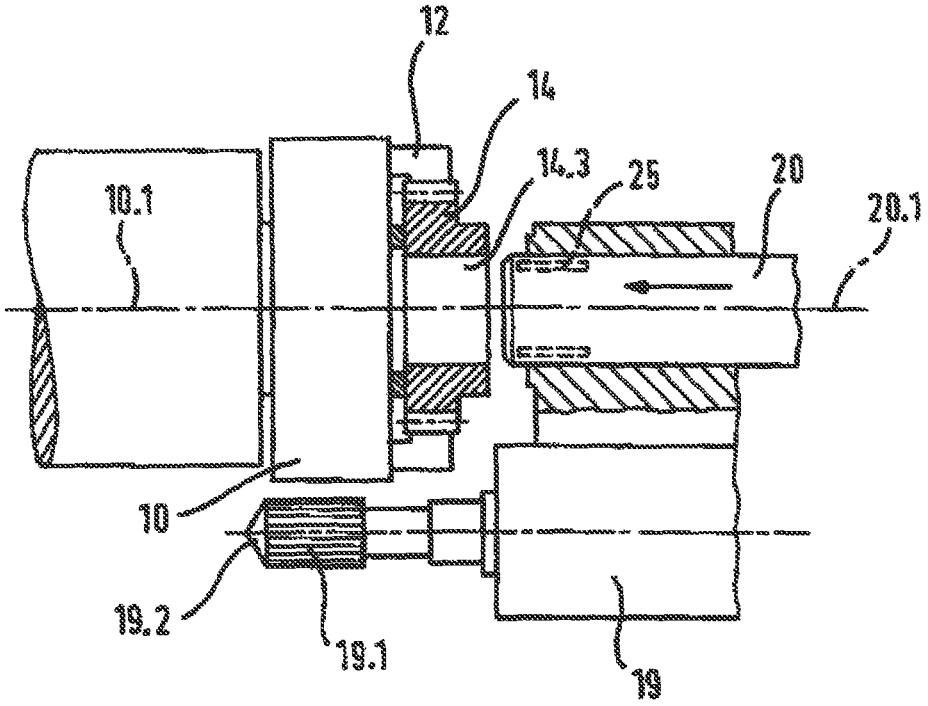
FIG. 4: A position of the second grinding headstock, in which the clamping device is aligned in relation to the central axis of the clamping device of the workpiece headstock and is shortly before the insertion of the workpiece into the bore.

In FIG. 4, the final machining of the planar and non-planar external surfaces 14.1, 14.4 has taken place, and the internal surfaces of the bore 14.3 of the workpiece 14 have been finished and the grinding headstock 17 has been moved, through its CNC-controlled axes, in such a way that the internal grinding wheel 19.1 is positioned in parallel to the central axis 10.1 of the workpiece spindle in such a way that the mandrel 20 is located immediately in front of the bore 14.3 of the workpiece 14 in order to finally be able to be brought into its corresponding axial displacement 21 for the purpose of the clamping in this bore 14.3. The geometry of the workpiece spindle 10, as well as the grinding spindle 19 for the internal grinding wheel 19.1, is thereby selected in such a way that there are no obstructing contours between the workpiece headstock and the grinding spindle 19 or the internal grinding wheel 19.1.

In order to achieve an improved distribution of the cooling lubricant, even in the internal grinding wheel 19.1 or the grinding pin, upon a feeding of the cooling lubricant through the workpiece spindle 10, it is advantageous to provide the grinding pin with a conical extension 19.2.

Figure 5:
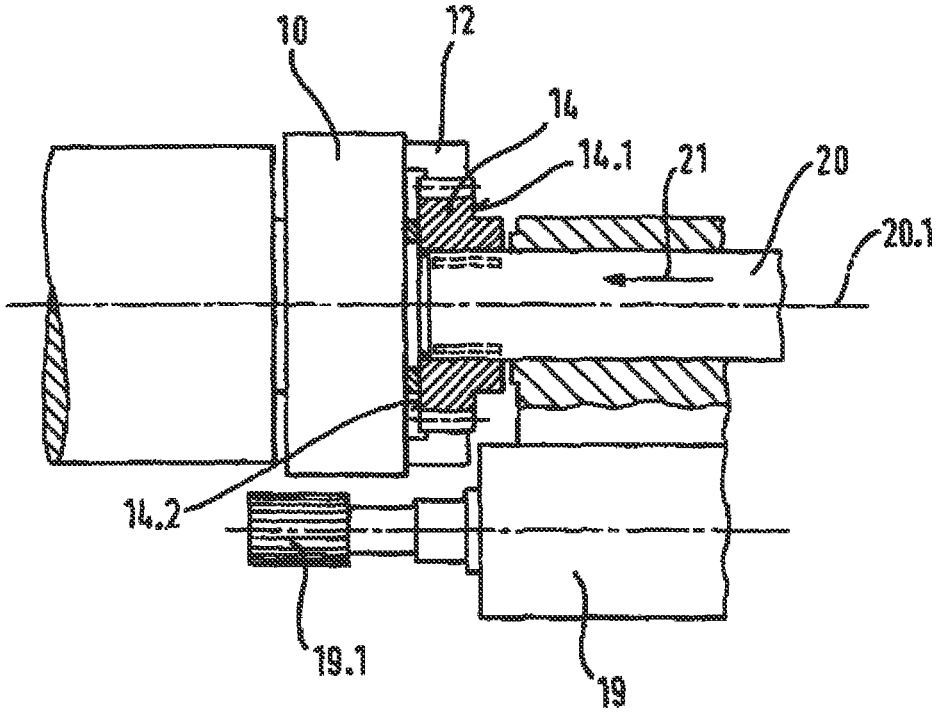
FIG. 5: A subsequent position of the second grinding headstock at the position in accordance with FIG. 4 upon insertion into the bore of the workpiece and the clamping device in the clamping position.

FIG. 5 now depicts, in relation to FIG. 4, the moment at which the mandrel 20 is, after its axial displacement 21, moved into the bore 14.3 and holds the workpiece 14 there in a clamped manner. The clamping is thus carried out in such a way that the central axis of the mandrel 20.1 aligns precisely with the central axis 10.1 of the workpiece spindle 10. At this moment, the workpiece is clamped, both with the clamping chuck 12 of the workpiece spindle 10, as well as with the mandrel 20 of the grinding headstock 17, and thus clamped twice, so to speak. Only if the complete clamping of the workpiece 14 is carried out by means of the mandrel 20 in the bore 14.3 the clamping chuck 12 of the workpiece 14 can be detached and the grinding headstock 17 moved along its CNC-controlled axis and, specifically so, to the right in FIG. 5.

The clamping and the handing over of the workpiece 14 from the clamping chuck 12 to the mandrel 20 can take place upon a stationary or a rotating workpiece spindle 10. Upon a clamping with rotating workpiece spindle 10, the mandrel 20 must then also rotate with the same rotational speed and the same rotational direction. Thereby, the reclamping time can be optimized.

If the grinding headstock 17 has been moved with the workpiece 14 (see FIG. 6), then the second planar external surface 14.2 can be ground with the external grinding wheel 3.1, which is held on the corresponding grinding spindle 3 and is driven thereby, since the workpiece 14 is now clamped completely and reliably and precisely with the mandrel 20 in the inner bore of the workpiece by means of the hydro-expansion clamping element 25.

If the workpiece has been clamped with the mandrel 20 and the mandrel has set the workpiece into rotation, which is indicated by the circular arrow on the right-hand side, then the second planar external surface 14.2 is also ground by a likewise-driven external grinding wheel 3.1. The internal grinding wheel 19.1 is, with its grinding spindle 19 in this position, moved to the side, so to speak, and brought out of engagement.

The mandrel is configured in such way that its concentricity error is, in general, only a few μm. As a result, in accordance with this process and with this grinding machine, highly precise workpieces can be produced in a single grinding machine on both sides and on one and the same grinding machine, in the sense of a complete machining of the workpieces.

Depending on the configuration of the workpiece 14, it is, naturally, also possible for non-planar external surfaces to be ground on the opposing planar side 14.2. In such a case, for example, a profiled grinding wheel can be used instead of the straight plunge grinding wheel 3.1 and, namely, of the type of external grinding wheel 4.1 depicted in FIG. 3.

Figure 6:
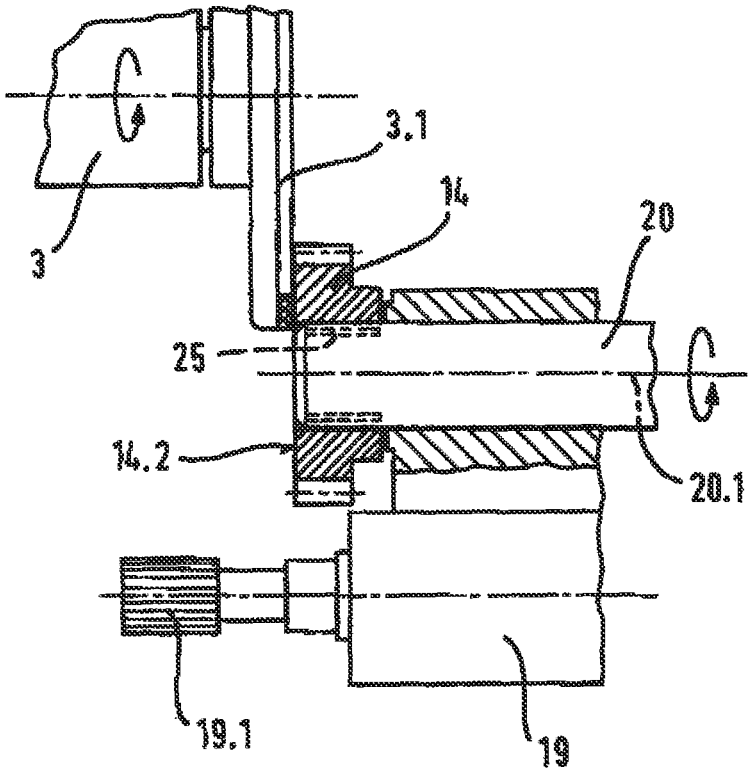
FIG. 6: The workpiece clamped into the bore by means of the clamping device which, in the straight plunge grinding process, undergoes a grinding of the opposing planar side.
Figure 7:
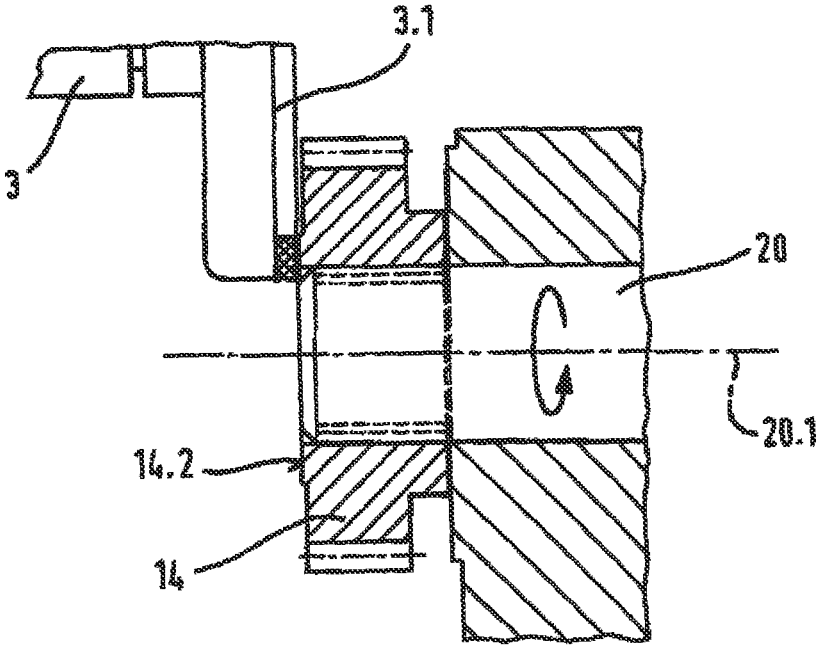
FIG. 7: An enlarged depiction of the grinding of the opposing planar side by means of a straight plunge grinding wheel.

The machining situation in accordance with FIG. 6 is depicted in FIG. 7, in enlarged representation, whereby the second planar external surface 14.2 is additionally stepped. With the planar grinding wheel 3.1, both parts of the planar external surface 14.2 can obviously be reliably ground.

Figure 8:
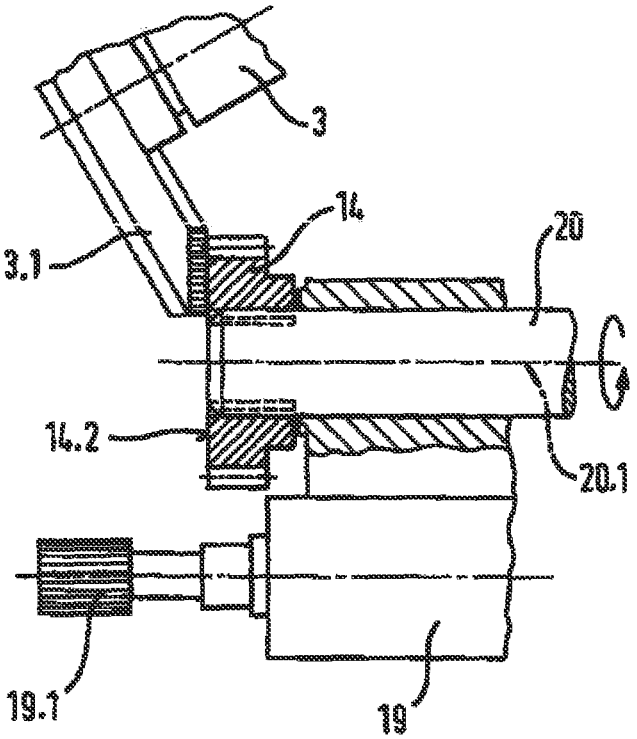
FIG. 8: A grinding of the opposing planar side by means of an angular infeed grinding process or angular plunge grinding wheel, respectively.

The position for the grinding of the second planar external surface 14.2 is depicted in FIG. 8 by analogy to FIG. 6, but by means of an external grinding wheel 3.1, which is used in the angular plunge grinding process. This external grinding wheel 3.1 is then positioned, during the corresponding arrangement with its grinding spindle 3, on the first grinding headstock 2 (not depicted here). With such an arrangement, additional non-planar external surfaces can also be ground on the opposing planar side, i.e., cylindrical or conical sections on the workpiece on its second side, if applicable, for which either the external grinding wheel 3.1 depicted or a profiled grinding wheel in accordance with its embodiment given in FIG. 3, but under another angular placement or adjustment, can be used. Whether the opposing planar side by way of a straight plunge grinding or an angular plunge grinding is machined depends on the grinding task required and, naturally, also on the geometry of the workpiece 14. The grinding machine in accordance with the invention can, in this regard, be correspondingly adjusted on an individual basis on the workpiece and the grinding task adjusted, without the basic design depicted in FIG. 1 having to be differently configured.

Figure 9:
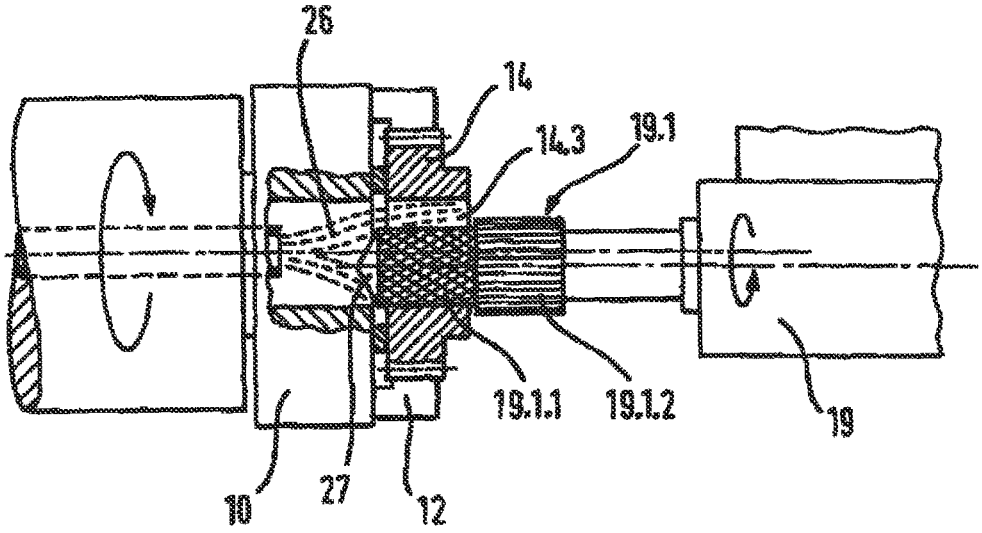
FIG. 9: An internal grinding of the bore of the workpiece by means of an internal grinding wheel with a rough-grinding and a finish-grinding area with simultaneous feeding of cooling lubricant through the workpiece headstock to the grinding position.

An additional preferred embodiment of the grinding machine is depicted in FIG. 9, upon the grinding of the bore 14.3 of the workpiece 14 by means of the internal grinding wheel 19.1. For the sake of clarity, the external grinding wheel 4.1 (see FIG. 3) has been omitted here. The internal grinding wheel 19.1 is configured as a grinding mandrel and has two grinding areas 19.1.1 and 19.1.2 with different grinding coatings. The first, advancing grinding coating 19.1.1 serves for the rough-grinding of the internal surfaces of the bore 14.3, and the second, trailing grinding coating 19.1.2 serves for the finish-grinding of the bore. Since the diameter of the second grinding coating 19.1.2 is greater than that of the first grinding coating 19.1.1, after the ending of the rough-grinding by means of the first grinding coating 19.1.1 the grinding headstock 17 with the grinding spindle 19, is obliquely adjusted to the central axis corresponding to the X2 axis, and this second grinding area 19.1.2 is inserted into the bore for the finish-grinding. The first grinding area 19.1.1 then projects into the open space within the workpiece spindle 10. As a general rule, the rough-grinding wheel should be the one which is furthest away from the bearing of the spindle. Such two-stage internal grinding wheels 19.1 are used, above all, if the bore 14.3 of the workpiece 14, for example, has increased grinding allowances or if the grinding allowances vary strongly from the pre-machining. This rough-grinding can also be advantageous, depending on which material is to be machined.

A grinding coating 19.1.2 with ceramically bound CBN is also used here for the finish-grinding, so that correspondingly good surface qualities and a high precision are achieved. For the rough-grinding, grinding can likewise be carried out with ceramically bound CBN; however, a grinding coating 19.1.1 with galvanically coated CBN coating can likewise be used. Grinding wheels with galvanically coated CBN generally have a greater stock removal capacity, and they are, as a result, particularly well suited for rough-grinding processes. Upon such a two-stage internal grinding wheel 19.1, the optimization of the grinding processes and the achievable precision are possible with the same technical machine design.

During the grinding, it is necessary for cooling lubricant 26 to be supplied to the grinding wheel 19.1 which is engaged. In accordance with this embodiment, the cooling lubricant 26 is fed through the interior of the workpiece spindle 10 and moved forward to the actual grinding engagement. In order to obtain an improved distribution of the cooling lubricant 26, the forward part, i.e., the rough-grinding area 19.1.1 of the internal grinding wheel 19.1, can have a conical attachment for the improved distribution of the cooling lubricant 26. Such a conical attachment does not have to be present, however. The advantage of such a conical attachment 27 on the forward end of the internal grinding wheel 19.1 consists of a lower turbulence of the cooling lubricant 26 upon the feeding to the grinding position, whereby the supply of the grinding zone with cooling lubricant, and thereby the grinding conditions, are improved.

As a result, this has a positive effect on the precision of the grinding result and the surface properties of the finish-ground workpiece.

Figure 10:
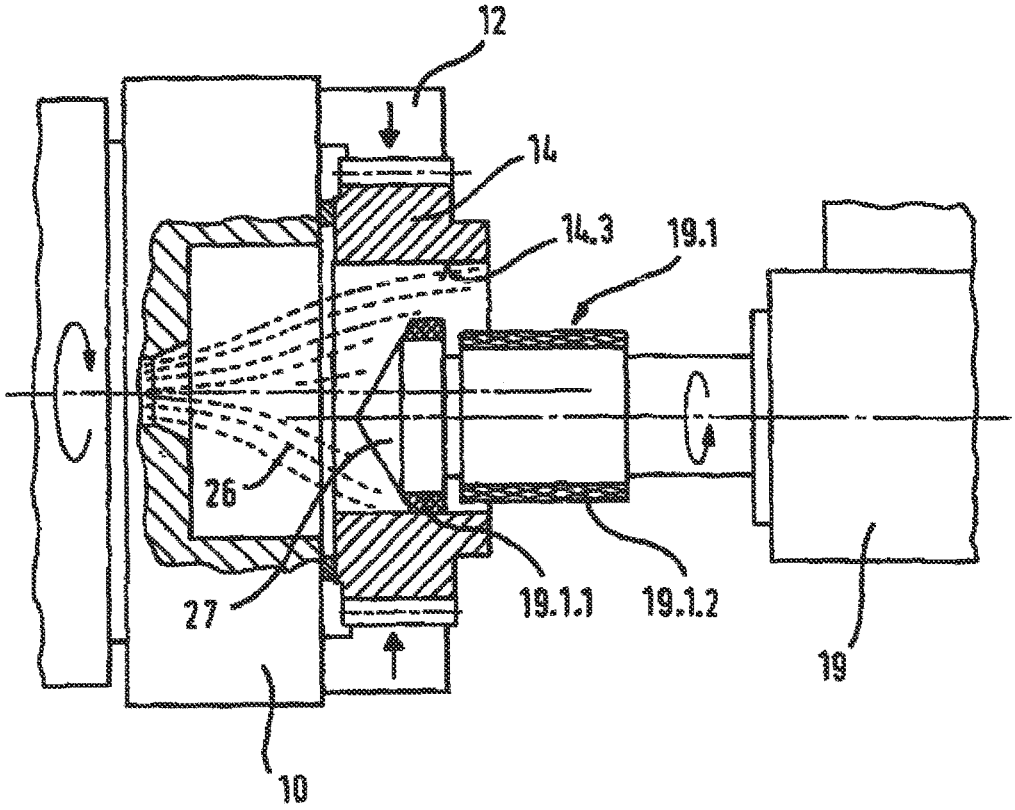
FIG. 10: An internal grinding of the bore with an internal grinding wheel with a rough-grinding and a finish-grinding area upon rough-grinding in the peel grinding process and finish-grinding in the plunge grinding process.

FIG. 10 shows an additional preferred embodiment, analogous to that depicted in FIG. 9, in which the internal grinding wheel 19.1 is likewise provided in two stages, with a first, advancing grinding area 19.1.1 and a second, trailing grinding area 19.1.2. The first, advancing grinding area 19.1.1 has a greater diameter than the second, trailing grinding area 19.1.2. The first grinding area 19.1.1 is constructed clearly narrower than the one of the second grinding area 19.1.2, since, with the rough-grinding area 19.1.1 by way of the peel grinding, a relatively large allowance is ground away, whereby CBN is advantageously used as a grinding coating. If the rough-grinding is ended, then the internal grinding wheel 19.1 is moved so far into the bore, with its second grinding area 19.1, that the bore can be finish-ground by way of the internal cylindrical grinding, particularly also the plunge grinding. Thereby, the first grinding area 19.1.1 is moved so far into the open space within the workpiece spindle 10 that the second grinding area 19.1.2 can be moved, through the X2 axis of the grinding spindle 19, to the internal surface of the bore 14.3 to be ground.

The forward grinding area 19.1.1 of the internal grinding wheel 19.1 likewise has a conical attachment 27, which serves for the more uniform distribution of the cooling lubricant 26 to the corresponding grinding engagement point.

The arrows indicated in the clamping chuck 12 on the clamping jaws are intended to show that the clamping chuck holds the workpiece 14 in the clamped condition, as long as surfaces to be ground are machined.

In this implementation of the rough-grinding, the grinding time on the workpiece can be optimized by the rough-grinding with the first grinding area 19.1.1 with the infeed direction of the internal grinding wheel 19.1 in the direction of the clamping chuck 12 on the clamped workpiece 14, in such a way that the "running-in movement" of the grinding pin 19.1 is already used for the rough-grinding. This makes it possible for complete final grinding to be carried out with a very low grinding allowance with the second grinding area 19.1.2 of the internal grinding wheel 19.1. In this way, the entire grinding time for the bore 14.3 can be completely optimized.

By combining a grinding headstock for the internal grinding and a clamping device into a single construction unit, the advantages of the grinding spindle, which in any event requires a high stability, can be used for both parts of the combined unit for clamping devices requiring a high precision.

The invention claimed is:

1. Grinding machine for the complete machining of workpieces with a central bore, and external surfaces comprising:

a first grinding headstock with an external grinding wheel for the grinding of the external surfaces, a workpiece headstock with a clamping chuck for clamping of a workpiece aligned to a central axis of the clamping chuck, and a second grinding headstock with an internal grinding wheel for the grinding of an internal surface of the central bore, whereby the workpiece can be clamped in a first clamping position in the clamping chuck of the workpiece headstock for the grinding of at least a first external surface pointing in a direction of the second grinding headstock with the external grinding wheel and grinding of the internal surface of the central bore with the internal grinding wheel, characterized in that, the second grinding headstock supports a clamping device, which is movable in relation to a clamping axis in such a way that it can be inserted into the previously ground central bore of the workpiece, and the workpiece can be clamped at a place by the clamping device in a second clamping position, in which the clamping axis of the clamping device in the second clamping position and the central axis of the clamping chuck align, and both clamping positions exist at least temporarily simultaneously, whereby, in the second clamping position after the first clamping position has been released, grinding of at least a second external surface pointing in a direction of the workpiece headstock can be ground with the external grinding wheel.

2. Grinding machine in accordance with claim 1, characterized in that, the clamping device is movable axially and is, in particular, controlled by CNC.

3. Grinding machine in accordance with claim 1, characterized in that, the clamping device is a mandrel, which is driven in a rotary manner.

4. Grinding machine in accordance with claim 3, characterized in that, the mandrel has a hydro-expansion element.

5. Grinding machine in accordance with claim 1, characterized in that, the first grinding headstock has two grinding spindle units with corresponding grinding wheels for the machining of the first and the second external surfaces, whereby the grinding spindle units move into the X1 and Z1 axial direction and from the grinding headstock around a B-axis in a CNC-controlled manner.

6. Grinding machine in accordance with claim 5, characterized in that, the first grinding headstock has a truing spindle with a diamond truing disk for the truing of the internal grinding wheel.

7. Grinding machine in accordance with claim 1 characterized in that, the grinding spindle unit positioned on the second grinding headstock can be moved in the X2 and Z2 axial direction in a CNC-controlled manner.

8. Grinding machine in accordance with claim 1, characterized in that, the workpiece headstock has two workpiece spindles, each with one clamping chuck, which are positioned opposite one another and can be swiveled, using a rotating unit, out of a first position, in which at least the first external surface and the central bore of the workpiece to be ground can be ground, into a second position, in which the finish-ground workpiece is in a loading position.

9. Grinding machine in accordance with claim 1, characterized in that, the first and the second grinding headstock are each positioned on a cross-slide unit.

10. Grinding machine in accordance with claim 1, characterized in that, the internal and the external grinding wheels can be brought into grinding engagement in a controlled manner in such a way that at least the first external surface and the central bore are at least temporarily simultaneously ground.

11. Process for the complete grinding of workpieces with a central bore and external surfaces, the process comprising:

providing a grinding machine comprising:

a first grinding headstock with an external grinding wheel for the grinding of the external surfaces, a workpiece headstock with a clamping chuck for clamping of a workpiece aligned to a central axis of the clamping chuck, and a second grinding headstock with an internal grinding wheel for the grinding of an internal surface of the central bore, whereby the workpiece can be clamped in a first clamping position in the clamping chuck of the workpiece headstock for the grinding of at least a first external surface pointing in a direction of the second grinding headstock with the external grinding wheel and grinding of the internal surface of the central bore with the internal grinding wheel, characterized in that, the second grinding headstock supports a clamping device, which is movable in relation to a clamping axis in such a way that it can be inserted into the previously ground central bore of the workpiece, and the workpiece can be clamped at a place by the clamping device in a second clamping position, in which the clamping axis of the clamping device in the second clamping position and the central axis of the clamping chuck align, and both clamping positions exist at least temporarily simultaneously, whereby, in the second clamping position after the first clamping position has been released, grinding of at least a second external surface pointing in a direction of the workpiece headstock can be ground with the external grinding wheel, clamping the workpiece in the clamping chuck of the workpiece headstock aligned to the central axis of the clamping chuck;

grinding the first external surface using the external grinding wheel;

grinding the internal surface of the central bore, at least temporarily, using the internal grinding wheel; the first external surface using the external grinding wheel;

inserting the clamping device, positioned by the second grinding headstock, into the central bore of the workpiece;

clamping the workpiece with the clamping device at least temporarily simultaneously as the workpiece is also clamped with the clamping chuck in such a way that the central axis of the clamping chuck of the workpiece headstock and the clamping axis of the clamping device on the second grinding headstock align with one another; after which the clamping with the clamping chuck is released; and grinding the second external surface positioned essentially opposite the first external surface using the external grinding wheel.

12. Process in accordance with claim 11, in which the clamping device is controlled hydraulically from its release position into its clamping position and vice versa.

13. Process in accordance with claim 11, in which the clamping device is controlled mechanically, electrically or electromagnetically out of its release position and into its clamping position and vice versa.

14. Process in accordance with claim 11, in which the workpiece headstock swivels a loaded workpiece into a grinding position.

15. Process in accordance with claim 11, in which a plurality of external surfaces are ground essentially simultaneously using a profiled grinding wheel.

16. Process in accordance with claim 11, in which the second external surface are ground in a straight infeed plunge grinding process.

17. Process in accordance with claim 11, in which the second external surface and additional non-planar external surfaces are ground essentially simultaneously in the angular infeed plunge grinding process using the grinding wheel.

18. Process in accordance with claim 11, in which cooling lubricant for the internal grinding wheel is fed through the interior of the workpiece headstock.

19. Process in accordance with claim 11, in which the cooling lubricant is distributed in the bore on the internal grinding wheel through the conical design of the end of the internal grinding wheel.

20. Process in accordance with claim 11, in which the internal grinding wheel rough-grinds the bore with the first grinding area and finish-grinds it with the second grinding area.

21. Process in accordance with claim 20, in which the internal grinding wheel rough-grinds the bore with the first grinding area using infeed plunge grinding.

22. Process in accordance with claim 20, in which the internal grinding wheel with the first grinding area rough-grinds the bore using peel grinding.

* * * * *